US005956763A

United States Patent [19]

Blackshear

[11] Patent Number: 5,956,763

[45] Date of Patent: Sep. 28, 1999

[54] DISPOSABLE BIB WITH LAP PROTECTOR

[76] Inventor: Walter W. Blackshear, 3000 Quail Hollow Cr., Baytown, Tex. 77521

[21] Appl. No.: 09/152,506

[22] Filed: Sep. 14, 1998

Related U.S. Application Data

[60] Provisional application No. 60/059,512, Sep. 19, 1997.

[51] Int. Cl.[6] ..... A41B 13/10

[52] U.S. Cl. ..... 2/49.1; 2/46; 2/50

[58] Field of Search ..... 2/46, 48, 49.1–49.5, 2/50–52

[56] References Cited

U.S. PATENT DOCUMENTS

| | | | |
|---|---|---|---|
| D. 152,879 | 3/1949 | Grassi . | |
| D. 325,115 | 4/1992 | Vassar, Sr. . | |
| 2,265,690 | 12/1941 | Fiedler . | |
| 3,857,116 | 12/1974 | Meeker | 2/50 |
| 4,114,199 | 9/1978 | Malan . | |
| 4,649,572 | 3/1987 | Roessler . | |
| 4,660,224 | 4/1987 | Ashcraft | 2/48 |
| 4,797,952 | 1/1989 | Petrini . | |
| 5,056,159 | 10/1991 | Zemke, Jr. | 2/49 |
| 5,062,558 | 11/1991 | Stang . | |
| 5,181,275 | 1/1993 | Spulgis | 2/48 |
| 5,220,692 | 6/1993 | Cox | 2/48 |
| 5,457,820 | 10/1995 | Yielding . | |
| 5,530,968 | 7/1996 | Crockett . | |
| 5,778,450 | 7/1998 | Hagestad et al. | 2/49.3 |

*Primary Examiner*—Gloria Hale
*Attorney, Agent, or Firm*—Richard C. Litman

[57] ABSTRACT

A bib for use by motor vehicle occupants generally comprises a torso panel adapted to cover a person's torso, a pocket portion which folds out from the torso panel to catch spilled food and beverages formed on the bottom of the torso panel, a wire reinforced tab formed in an upper portion of the torso panel for securing the bib to a person's shirt collar, and two adhesive tabs attached at opposing sides of a lower portion of the bib for securing the lower portion to a user's body. The torso panel and pocket portion are both made from a light weight, flexible, and water proof plastic material so that the bib may be inexpensively and easily manufactured, and the pocket portion is reinforced by a wire having substantial stiffness so that the pocket portion won't collapse when it becomes filled with a liquid.

14 Claims, 3 Drawing Sheets

DISPOSABLE BIB WITH LAP PROTECTOR

CROSS-REFERENCE TO RELATED APPLICATION

This application claims the benefit of U.S. Provisional Patent Application Serial No. 60/059,512, filed Sep. 19, 1997.

BACKGROUND OF THE INVENTION

1. Field of the Invention

The present invention relates to a bib and, more specifically, to a bib with a pocket portion formed thereon to prevent food and drinks from spilling or falling onto the user's lap.

2. Description of Related Art

Eating and drinking while driving or riding in a car have become ever more common with the proliferation of fast food outlets and quick stop convenience stores. While this is convenient and time saving for most people, food and drink are often spilled while the vehicle is in motion causing substantial damage to people's clothing and to the interior of the automobile.

One common way of dealing with this problem is to use a bib or a similar device to prevent spilled food and drink from contacting a person's clothing or the interior of the a car in which they are traveling. Several devices of this general type have been disclosed in the prior art. These have included bibs which have lap covering portions which prevent spilled food and drink from contacting the user's clothing and bibs with rigid trays or soft pockets formed thereon to catch spilled food and drink.

U.S. Pat. No. 5,056,159, issued Oct. 15, 1991 to William L. Zemke, Jr., discloses a device for protecting a user's garments from spilled food and drink. The device is formed from two sheets of a flexible material which are joined on opposite sides by two sidewalls to define a cavity when in packaged form. Perforations are made around three sides of the top sheet so that it may peeled up to form a bib portion, leaving the bottom sheet and sidewalls to form a tray portion adapted to catch spilled food and drink. Additionally, the bib has a neck encircling piece formed on the top thereof and two adhesive backed tabs formed on opposite sides thereof to attach the device to the user.

U.S. Pat. No. 5,530,968, issued Jul. 2, 1996 to Wendy P. Crockett, discloses a bib intended to be used by automobile drivers and passengers as they commute to work. The bib is formed from a single sheet of flexible water impervious material by cutting a neck encircling portion through the sheet adjacent the top thereof and folding the bottom edge of the sheet up and securing the edges thereof to the middle of the sheet to form a debris receiving pocket.

U.S. Pat. No. 5,220,692, issued Jun. 22, 1993 to Lamar Cox, also discloses a garment protecting device intended to be worn by automobile drivers and passengers. The device has a neck encircling strap which secures a bib portion over the user's torso and a lap covering portion formed integrally on the bottom of the bib portion. The opposite side edges of the lap portion are reinforced with elongate weights to ensure that the lop portion lies flat over the user's legs.

U.S. Pat. No. 4,114,199, issued Sep. 19, 1978 to Mabel Malan, and U.S. Pat. No. 5,062,558, issued Nov. 5, 1991 to Michael A. Stang, disclose bibs having trays adapted to catch spilled food and drink formed on their bottom edges. The tray on the bib of Malan is preformed thereon by folding the peripheral edges of the bottom portion of the bib upward and securing them to each other with an adhesive to form the sidewalls defining the tray while the tray on the bib of Stang is formed by inserting a rigid cardboard member into a cavity formed in the flexible material of the bib.

U.S. Pat. No. 2,265,690, issued Dec. 9, 1941 to Josephine Fiedler, discloses an apron having a tray adapted to catch food therein formed on the bottom edge thereof. The tray on the apron of Fiedler is also formed by folding the peripheral edges of the bottom of the apron upward to define the sidewalls of the tray. However, the sidewalls of the tray have tongues formed thereon which overlap each other and a keeper loop so that a removable key may be used to secure the sidewalls in place so that the tray may be easily unfolded.

U.S. Pat. No. 4,649,572, issued Mar. 17, 1987 to Thomas H. Roessler, and U.S. Pat. No. 4,797,952, issued Jan. 17, 1989 to Grace Petrini, disclose general purpose disposable bibs having neck encircling portions formed on the top thereof and debris receiving pockets formed on the bottom thereof. The debris receiving pockets on both bibs are formed by folding the bottom edge of the sheet from which the bib is formed up and securing its opposite edges to middle of the bib to define the pocket.

U.S. Pat. No. 5,457,820, issued Oct. 17, 1995 to Patricia G. Yielding, discloses a bib adapted to be used by an infant in a car seat. The bib has a neck encircling member formed on the top thereof and two car seat attaching members formed on the bottom thereof.

U.S. Pat. No. Des. 152,879, issued Mar. 1, 1949 to Louis Grassi, and U.S. Pat. No. Des. 625,115, issued Apr. 7, 1995 to Charles W. Vassar, Sr., disclose decorative designs for bibs having trays or pockets formed on the bottom edge thereof.

However, none of the prior art discloses a bib having a tab formed in an upper portion of the bib having a reinforced end for securely supporting the bib from a person's collar. Additionally, none of the prior art discloses an adhesive tab attached to the sides of a bib at a lower portion thereof for anchoring the lower portion of the bib to a person wearing the bib. None of the above inventions and patents, taken either singly or in combination, is seen to describe the instant invention as claimed.

SUMMARY OF THE INVENTION

The present invention relates to a bib which is useful in many different situations but which is specifically adapted to be used by automobile drivers and passengers to protect their garments from food and beverage spillage that often occurs during traveling. The bib generally comprises a torso panel adapted to cover the front of a person's torso, a pocket portion formed in a lower portion of the bib which folds out from the torso panel to catch spilled food and beverages formed on the bottom of the bib, a reinforced tab formed in an upper portion of the torso panel for securing the bib to a person's collar, and an adhesive tab attached to a lower portion of the bib at two opposing sides thereof for securing the lower portion of the bib to a user's legs. A reinforced span is provided along the lower edge of the bib to stiffly but bendably support the bib and its pocket portion between the legs of the user. The torso panel and pocket portion are both made from a light weight, flexible, and water proof plastic material so that the bib may be cheaply and easily manufactured.

Accordingly, it is a principal object of the invention to provide a bib which may be easily attached to a person's shirt using reinforced tabs.

It is another object of the invention to provide a bib having a pocket portion formed in a bottom portion thereof which is adapted to catch spilled food and beverages therein.

It is a further object of the invention is to provide a bib which may be easily put on and worn by a person driving or riding in an automobile.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2B:
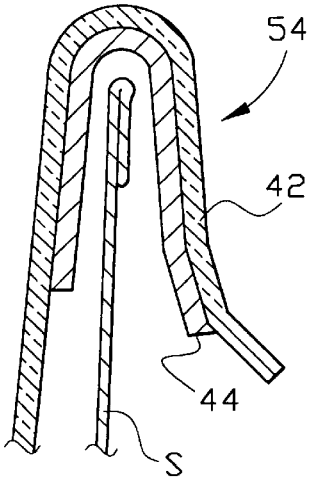
FIG. 2B is a cross-sectional, detail view of the reinforced neck tab of the disposable bib of FIG. 2A as drawn along lines 2B—2B.
Figure 2A:
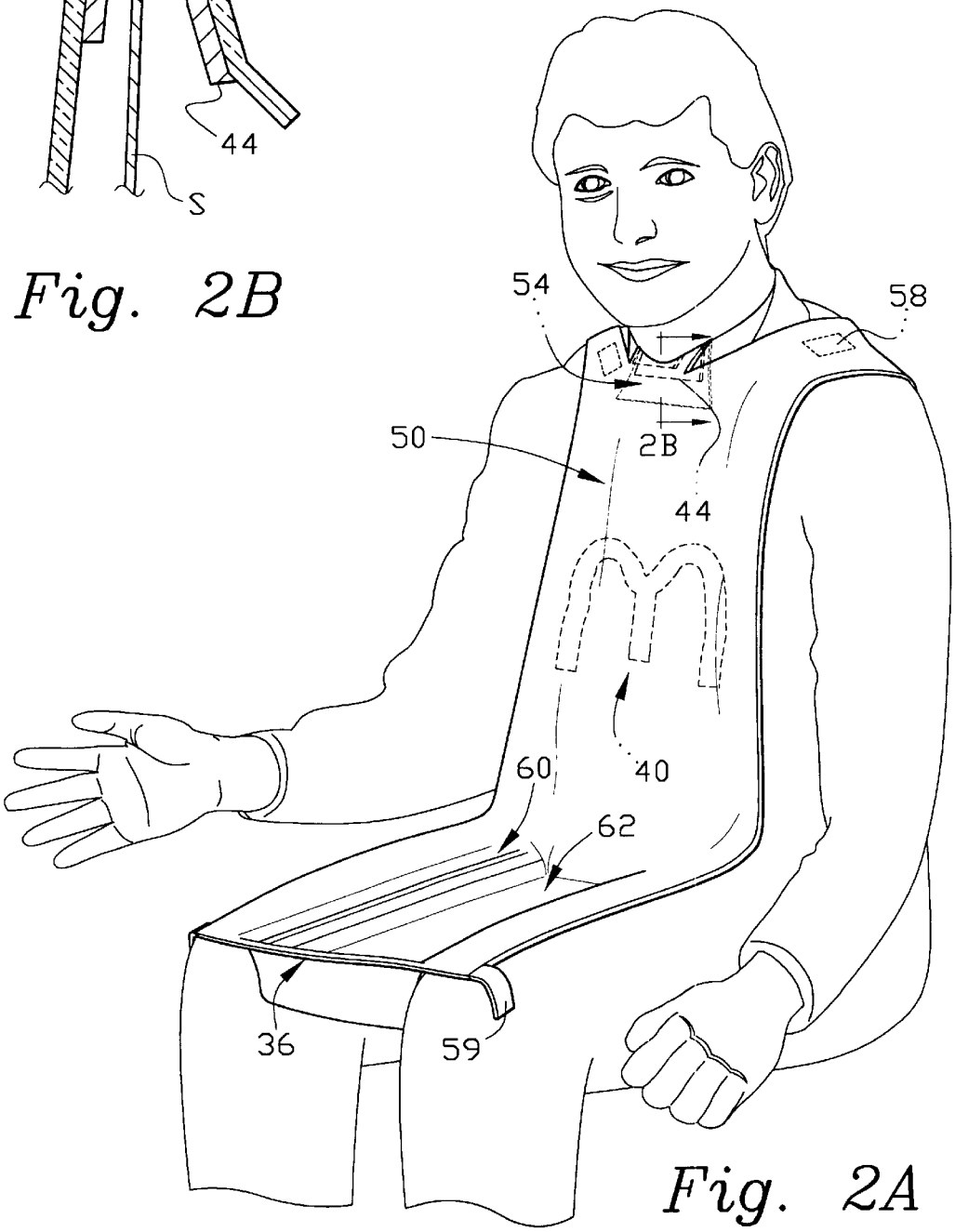
FIG. 2A is a perspective, environmental view of a disposable bib according to a preferred embodiment of the invention.

An environmental view of a bib 50 according to a preferred embodiment of the present invention is shown in FIG. 2A. As shown in FIG. 2A, the bib 50 is adapted to be worn by a person while in a seated position. The bib 50 is particularly adapted for use by automobile drivers and passengers to protect their garments from food and beverage spillage that often occurs when traveling.

Figure 1:
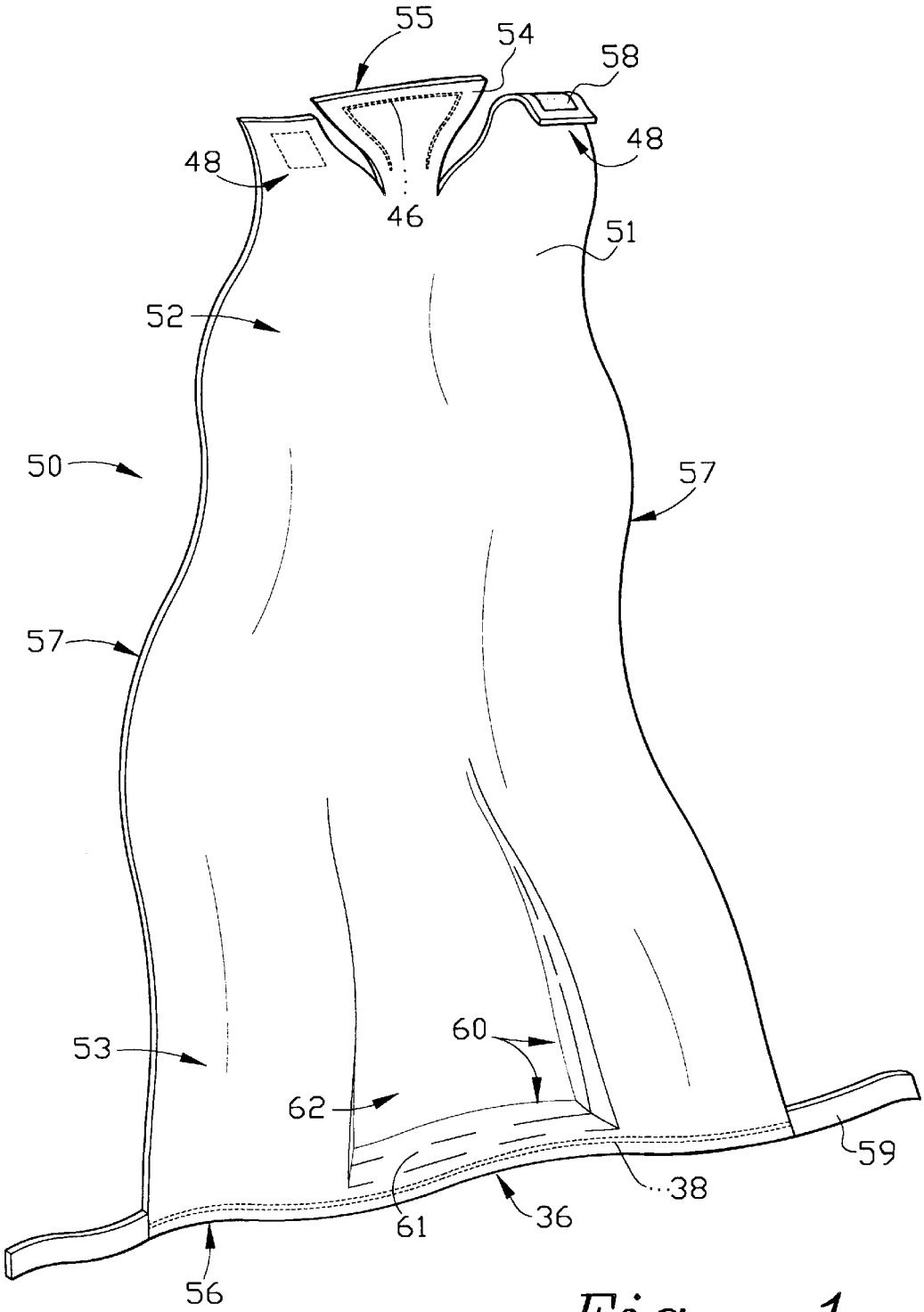
FIG. 1 is a perspective view of a disposable bib having a pocket portion according to a preferred embodiment of the present invention.

A perspective view of a bib 50 according to a preferred embodiment is shown in FIG. 1. The bib 50 is generally defined by a torso panel 51 approximately having a trapezoidal shape, sized and dimensioned and particularly suited for covering a person's torso. Preferably, the torso panel is formed of a sheet of inexpensive light weight plastic material, which is waterproof and biodegradable, having an upwardly tapering trapezoidal shape. For example, the torso panel can be made of a laminated combination of a sheet of plastic material attached to a sheet of absorbent paper material. The plastic material would be effective for protecting a user's clothes from spilled liquids while the absorbent paper could be used to effectively absorb the liquids. Alternatively, the torso panel could be simply made of plastic material to simply protect a wearer's clothes from spilled liquids.

The torso panel 51 is further defined by an upper edge 55, a lower edge 56, two side edges 57, an upper portion 52 and a lower portion 53. According to a preferred embodiment, the upper edge 55 is approximately 8 to 10 inches in length; the lower edge is approximately 18 to 20 inches in length; and each of the side edges is approximately 24 to 30 inches in length. As can be seen in both FIGS. 2A and 3, the torso panel 51 provides ample space over the chest of the user for commercial advertising, as suggested by logos 40.

Formed in the upper portion 52 of the torso panel 51 is a first tab 54 that can be conveniently inserted into a person's collar for supporting the upper portion 52. The tab may be formed by a pair of simple cuts made into the upper portion 52, thereby defining the first tab 54 and a pair of shoulder tabs 48. The upper edge 55 of the first tab 54 is reinforced for preventing dislodgement of the first tab 54 when subjected to stresses associated with a user's movement inside an automobile. The upper edge 55 of the first tab 54 can be reinforced by various well known means. For example, the upper edge 55 can be folded over itself and sewn together. Alternatively, the upper edge 55 can be laminated to provide added rigidity. Another alternative is that wire 46 can be attached to or formed in the upper edge 55 for added reinforcement. This permits the tab 54 to be formed to the shirt and crimped thereto by bending and tucking the tab 54 into the neckline of the user's shirt.

As shown in FIGS. 2A and 2B, a second embodiment of the tab 54 is shown, wherein a cardboard reinforcement panel 44 is attached to a transparent sheet material 42 of the upper portion 52. The cardboard panel 44 may be adhered or otherwise affixed to the sheet material by known means, such as glues, stitching, etc. As can be seen the cardboard panel 44 adds sufficient rigidity to the tab 54 to permit the tab 54 to be crimped over behind the shirt S, the cardboard panel 44 deforming to the crimped shape after being bent. As yet another alternative embodiment shown in FIG. 3 and more fully described below, the neck tab 54 is replaced by a pair of collar tabs 22, which either comprise or include a rigid yet bendable material, such as a paper strip including wire 28 or a simple cardboard strip, for reinforcement and deformation which allows the collar tabs 22 to be crimped to the shirt of a user in a like manner as tab 54. Such collar tabs may be attached to the torso portion 52 of the alternative embodiment by any suitable attachment means known to one of ordinary skill in the art.

As shown in FIG. 1, attached to the torso panel 51 along the upper edge 55 of shoulder tab 48 is at least one piece of adhesive material 58 for providing an additional means supporting the torso panel 51. Preferably, the adhesive material 58 is attached the upper edge 55 at least two positions in close proximity to the side edges 57 for attaching the torso panel 51 to the shoulders of a person wearing the bib 50, as illustrated in FIG. 2A.

Formed in the lower portion 53 of the bib are a plurality of pleats 60 and a wall 61 fixedly attached to the lower edge 56 forming a pocket portion 62 for catching dropped food or spilled beverages in a user's lap. The pleats 60 are used to facilitate a natural expansion of the pocket portion 62 down in between a user's legs to catch any spilled beverages that may occurring during traveling. Preferably, the wall 61 is fixedly attached to the lower edge 56 by stitches. Alternatively, however, the wall 61 could be molded to the lower edge 56.

The lower edge 56 of the sheet material is reinforced by a stiff span 36 for preventing collapse of the wall 61 when the pocket portion 62 is filled with a beverage. Preferably, the lower edge 56 or span 36 is reinforced by wire 38 fixedly attached to the sheet material. Alternatively, however, the lower edge 56 can be reinforced by reinforcing folds formed in the sheet material, thus forming the span 36.

The lower portion 53 is further defined by an adhesive tab 59 attached to each of the two side edges 57 for securing the lower portion 53 of the bib 50 to a user's leg (as illustrated in FIG. 2A). A layer of releasable adhesive is provided on the side proximate the leg of the user. This configuration also serves to provide additional support for the pocket portion 62 to prevent collapse of the wall 61 when the pocket portion 62 is filled with a beverage.

Figure 3:
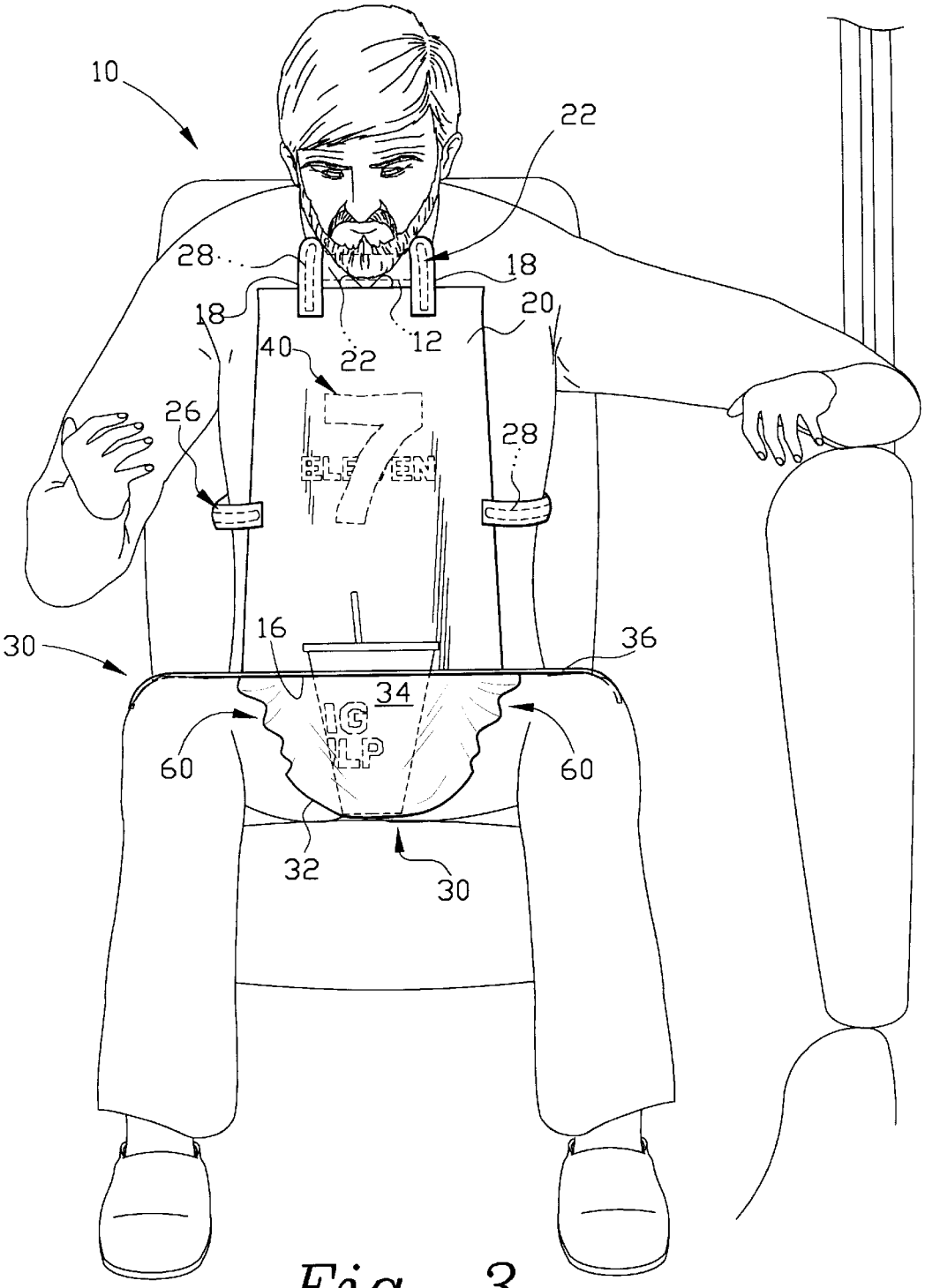
FIG. 3 is a perspective view of a disposable bib according to a second embodiment of the invention.

A bib 10 according to an alternative embodiment of the present invention can best be appreciated by referring to FIG. 3. The bib 10 generally comprises a torso panel 20 having a means for attaching to a person's shirt and a tray 30 formed on the bottom of the torso panel 20.

The torso panel 20 is preferably formed of a sheet of an inexpensive lightweight plastic material, which is waterproof and biodegradable, into an upwardly tapering trapezoidal shape. The front surface of the torso panel 20 is adapted to be imprinted with a logo or other advertising display 40. The means for attaching the torso panel 20 to a person's shirt are provided by a collar tab 22 attached to the top edge of the torso panel 20 and two side tabs 26 attached to the opposite side edges of the torso panel 20 at the approximate midpoint thereof.

The collar tab 22 is formed by two vertical members 18 which are attached to the top edge of the torso panel 20 so that they extend vertically upward therefrom and one horizontal member 12 which joins the top edges of the vertical members 18. The horizontal member 12 may be straight, as is illustrated in FIG. 3, but in the preferred embodiment, the horizontal member 12 forms an inverted U-shape on top of the vertical members so that the collar tab 22 has no sharp corners thereon which may be uncomfortable to the user of the bib 10. Additionally the collar tab 22 has a reinforcing wire 28 attached thereto along the length thereof which is adapted to give the collar tab 22 substantial rigidity while allowing the collar tab 22 to be folded into various positions. This allows the collar tab 22 to be folded over a person's shirt collar so that it may be used to secure the torso panel 20 on the person's shirt.

The side tabs 26 are attached to opposite side edges of the torso panel 20 so that they extend outwardly therefrom, and the side tabs 26 also have reinforcing wires 28 attached thereto along the length thereof. This allows the side tabs 26 to be folded backwards around a person's loose fitting shirt so that the material is clamped between opposing portions of the side tabs 26 to further secure the torso panel 20 on the person's shirt.

The tray 30 is also preferably formed of a sheet of an inexpensive lightweight plastic material which is waterproof and biodegradable. The tray 30 is defined by a rectangular bottom 32 which extends forward from the bottom edge 16 of the torso panel 20, a front wall 34 extending upwardly and outwardly from the front edge of the bottom 32, and two sidewalls formed by pleats 60 which extend rearwardly from the opposite side edges of the front wall to the opposite side edges of the torso panel 20. The front wall 34 forms a downwardly tapering trapezoidal shape so that the tray 30 forms an open topped bin with outwardly flared sidewalls (60) to help insure that any spilled food and beverages will be caught therein. The bottom 32, front wall 34, sidewalls 60, and the torso panel 20 are all joined together in a waterproof fashion so that no spilled beverages caught within the tray 30 will leak therefrom.

In order to lend rigidity to the tray 30 and to help the tray 30 maintain a useful shape, the front panel 34 has a horizontal reinforcement wire 36 attached thereto along the top thereof. The horizontal reinforcing wire 36 maintains the front wall 34 as a container, and since the front wall 34 extends outwardly from the bottom 32, the force of gravity acting to drop the bottom down from the front wall 34 and downward from the torso panel 20, thereby keeping the sidewalls 38 stretched tightly between the torso panel 20 and the front wall 34, particularly in the presence of a weighting object such as a drink cup or food.

In order to use the bib 10 of the present invention, a person must simply place the torso panel 20 against their chest, fold the collar tab 22 into their shirt collar, and pinch the side tabs 26 around loose material of their shirt along the sides of their abdomen. This offers advantages over typical bib attachment means, especially for automobile passengers and drivers, in that the person putting on the bib 10 need not insert their head through a neck encircling strap which often requires the use of both hands and which may temporarily obstruct a person's vision creating unsafe driving conditions.

Once attached to a person's shirt properly, the torso panel 20 covers the majority of the persons chest and the tray 30 rests on top of the person's lap to catch any dropped food or any food which may slide off the torso panel 20.

It is to be understood that the bib 10 of the present invention is not limited to the embodiments described above, but encompasses any and all embodiments within the scope of the following claims.

I claim:

1. A bib adapted to be worn by a person while seated, comprising:

a torso panel formed from a flexible and waterproof sheet material, wherein said torso panel is defined by an upper edge, a lower edge, and two side edges, wherein said torso panel is further defined by an upper portion and a lower portion;

a first tab formed in said upper portion of said torso panel for insertion into a person's collar to support said torso panel, wherein said first tab is reinforced along said upper edge for preventing dislodgement after being inserted into a person's collar;

a pocket portion formed in said lower portion of said torso panel for catching objects in an individual's lap, wherein said pocket portion is formed by at least two pleats formed in said lower portion and a wall formed in said lower portion and fixedly attached to said lower edge, and said lower edge of said sheet material is reinforced by a span along said lower edge; and an adhesive tab attached to each of said two side edges at said lower portion of said torso panel for attaching said lower portion to a user's body.

2. The bib as recited in claim 1, wherein said span includes a wire.

3. The bib as recited in claim 1, wherein said sheet material is formed by a plastic sheet integrally attached to a paper sheet.

4. The bib as recited in claim 1, wherein said first tab is folded along said upper edge for reinforcing said first tab.

5. The bib as recited in claim 1, wherein said first tab is reinforced by wire formed in said upper edge of said sheet material.

6. The bib as recited in claim 1, further comprising: adhesive material attached to said sheet material along said upper edge in close proximity to said two side edges for supporting said torso panel from a person's shoulders.

7. A bib adapted to be worn by a person while seated, comprising:

a torso panel formed of a flexible sheet material, said torso panel having a top edge, a bottom edge, and two side edges, said torso panel being configured to cover the front of a person's torso;

a means for attaching said torso panel to a person so that said torso panel covers the front of a person's torso; and a tray formed on the bottom of said torso panel, said tray being formed of a flexible sheet material, said tray being defined by a bottom having a front edge and a rear edge, said torso panel extending upwardly and rearwardly from said rear edge of said bottom, a front wall extending upwardly and forwardly from said front edge of said bottom, and a first sidewall and a second sidewall each extending upwardly from said bottom member between said front wall and said torso panel, said tray having reinforcing wires with significant rigidity attached thereto which are adapted to maintain said tray in an open position.

8. The bib according to claim 7, wherein said means for attaching said torso panel is provided by a collar tab attached to said top edge of said torso panel, said collar tab being formed of a flexible material, said collar tab extending upwardly from said top edge of said torso panel and being adapted to be folded over a person's shirt collar.

9. The bib according to claim 8, wherein said collar tab has a reinforcing wire attached thereto to provide a significant degree of rigidity to said collar tab.

10. The bib according to claim 9, wherein said collar tab is defined by two vertical members and one horizontal member, each of said vertical members having a top and bottom edge, said vertical members being attached to said top edge of said torso panel so that said vertical members extend upwardly therefrom in parallel spaced relation to each other, said horizontal member joining said top edges of said vertical members.

11. The bib according to claim 10, wherein said horizontal member forms an inverted U-shape on said vertical members so that there is an absence of sharp corners formed on said collar tab which could cause discomfort for a person using the bib.

12. The bib according to claim 8, wherein said means for attaching said torso panel further includes two side tabs formed of a flexible material, said side tabs being attached to said torso panel on opposite side edges thereof so that said side tabs extend horizontally outward therefrom, each of said side tabs having reinforcing wire attached thereto so that said side tabs may be folded back around a person's loose fitting clothing to further secure said torso panel.

13. The bib according to claim 7 wherein said front wall defining said tray has a top edge, a bottom edge, and two side edges; and wherein said reinforcing wires include a horizontal reinforcing wire fixedly attached to said top edge of said front wall of said tray along the length thereof to help maintain said tray in an open position and to help said tray rest on top of a person's lap.

14. The bib according to claim 7, wherein said front wall defining said tray has a top edge, a bottom edge, and two side edges defining a dimension adapted to fit between a person's knees; and wherein said reinforcing wires include a horizontal reinforcing wire fixedly attached to said top edge of said front wall of said tray along the length thereof, said horizontal reinforcing wire being adapted to rest on a person's knees to support said tray between the person's knees.

* * * * *